US006539097B2

(12) United States Patent
Sakai

(10) Patent No.: US 6,539,097 B2
(45) Date of Patent: Mar. 25, 2003

(54) MULTI-FUNCTIONAL VIBRATION ACTUATOR

(75) Inventor: Nobuyasu Sakai, Sendai (JP)

(73) Assignee: Tokin Corporation, Sendai (JP)

( * ) Notice: Subject to any disclaimer, the term of this patent is extended or adjusted under 35 U.S.C. 154(b) by 0 days.

(21) Appl. No.: 09/833,315

(22) Filed: Apr. 12, 2001

(65) Prior Publication Data

US 2002/0017824 A1 Feb. 14, 2002

(30) Foreign Application Priority Data

Apr. 14, 2000 (JP) ..... 2000-113314
Jan. 30, 2001 (JP) ..... 2001-021972

(51) Int. Cl.[7] ..... H04R 13/00

(52) U.S. Cl. ..... 381/413; 381/420; 340/388.1; 340/391.1

(58) Field of Search ..... 310/36, 81; 318/119; 340/388.1, 388.5, 391.1; 381/396, 398, 399, 411, 412, 413, 420, 421, 423

(56) References Cited

U.S. PATENT DOCUMENTS

RE32,785 E * 11/1988 Hirano ..... 381/413
5,467,323 A * 11/1995 Sone ..... 367/175
5,528,697 A 6/1996 Saito
5,604,816 A * 2/1997 Totani ..... 381/412
5,682,132 A * 10/1997 Hiroyoshi et al. ..... 310/29
5,861,686 A * 1/1999 Lee ..... 310/36

FOREIGN PATENT DOCUMENTS

EP 0 791 405 A2 8/1997
EP 0 845 920 A2 6/1998
EP 0 906 790 A1 4/1999

* cited by examiner

*Primary Examiner*—Burton S. Mullins
(74) *Attorney, Agent, or Firm*—Frishauf, Holtz, Goodman & Chick, P.C.

(57) ABSTRACT

A multi-functional vibration actuator comprises a vibration transmitting portion (8) forming a peripheral portion thereof, a magnetic circuit formed by a yoke (1), a permanent magnet (2), and a plate (3), a vibrator member (5) arranged at a distance from one surface of the magnetic circuit and having an outer periphery fixed to the vibration transmitting portion, a coil (6) arranged in a gap within the magnetic circuit at a distance from the magnetic circuit and fixedly attached to the vibrator member, and a suspension (4) fixed to the vibration transmitting portion and flexibly supporting the magnetic circuit. The distance (b) between the vibrator member and each of the one surface of the magnetic circuit and the suspension is greater than the distance (a) between the other surface of the magnetic circuit and a bottom cover (9) covering the magnetic circuit. By the use of an elastic member, such as an adhesive, applied in a spot-like fashion, a lead wire (19) extracted from the coil (6) is adhered to the outer periphery of the vibrator member where the vibration is small.

11 Claims, 2 Drawing Sheets

MULTI-FUNCTIONAL VIBRATION ACTUATOR

BACKGROUND OF THE INVENTION

This invention relates to a multi-functional vibration actuator generally mounted on a mobile communication apparatus, such as a mobile telephone, and having a function of generating a ringing tone or a speech sound in a sound mode and for generating tactile vibration in a vibration mode.

In a conventional multi-functional vibration actuator, a magnetic circuit comprising a yoke, a permanent magnet, and a plate is flexibly supported by a suspension comprising an arc-shaped helical leaf spring fixed to a vibration transmitting portion. The suspension of an arc shape has one end fixed to an outer periphery of the yoke of the magnetic circuit and the other end fixed to the vibration transmitting portion. The vibration actuator further comprises a vibrator member and a coil fixedly attached to a vibrator U-shaped portion of the vibrator member and is arranged in a gap within the magnetic circuit. As a consequence, the coil and the magnetic circuit are arranged on a single common axis. The vibrator U-shaped portion is formed at a desired position in a radial direction of the vibrator member. A lead wire for the coil is extracted outward from the vibrator member in a radial direction and is attached to an inner surface of an outer peripheral portion of the vibrator member through an elastic member such as an adhesive.

The outer peripheral portion of the vibrator member is fixed to the vibration transmitting portion. When the coil is applied with an a.c. driving current, the magnetic circuit or the coil moves towards or away from each other in an axial direction. The vibration transmitting portion serves as a fixed portion at a lower frequency and as an elastic member at a higher frequency to vibrate as a part of the vibrator member. In a vibration mode, the magnetic circuit and the coil attached to the vibrator member operate in reverse phases to transmit the vibration to the outside through the vibration transmitting portion.

In the structure of the conventional multi-functional vibration actuator, a distance between the vibrator member and each of one surface of the magnetic circuit and the suspension has a minimum value substantially equal to a distance between the other surface of the magnetic circuit and a cover faced thereto. If an amplitude of the movement of the magnetic circuit and the vibrator member is increased in the vibration mode, the magnetic circuit and/or the suspension may be brought into contact with the vibrator member to generate abnormal sound. Furthermore, depending upon the structure of the lead wire for the coil, the vibrator member may become unstable in operation in a sound mode. If an input driving voltage is increased or if the actuator is driven for a long time, the lead wire for the coil may be interrupted so that the actuator becomes inoperable.

SUMMARY OF THE INVENTION

It is therefore an object of this invention to provide a multi-functional vibration actuator in which a vibrator member is prevented from being brought into contact with a magnetic circuit and/or a suspension even if vibration of the vibrator member and the magnetic circuit is increased in a vibration mode and in which the vibrator member is stably operable in a sound mode.

According to this invention, there is provided a vibration actuator comprising a vibration transmitting portion forming a peripheral portion of the actuator, a magnetic circuit formed by the use of a permanent magnet, a vibrator member arranged at a distance from one surface of the magnetic circuit and having an outer periphery fixed to the vibration transmitting portion, a coil arranged in a gap within the magnetic circuit at a distance from the magnetic circuit and fixedly attached to the vibrator member, and a suspension fixed to the vibration transmitting portion and flexibly supporting the magnetic circuit, wherein the distance between the vibrator member and each of the one surface of the magnetic circuit and the suspension is greater than the distance between the other surface of the magnetic circuit and a cover covering the magnetic circuit.

Thus, the multi-functional vibration actuator of this invention has a structure such that the distance between the vibrator member and each of the one surface of the magnetic circuit and the suspension is greater than the distance between the other surface of the magnetic circuit and the cover. Furthermore, the vibrator member is formed in a shape such as a flat shape, a saucer shape, a curved shape, a corrugated shape, or a combination thereof with a desired radius of curvature such that a harmonic distortion component is minimized. With this structure, it is possible to avoid undesired contact between the magnetic circuit and the vibrator member around a resonance frequency in a vibration mode.

Preferably, the above-mentioned vibrator member is made of at least one kind of plastic film material selected from polyether imide (PEI), polyethylene terephthalate (PET), polycarbonate (PC), polyphenylenesulfide (PPS), polyarylate (PAR), polyimide (PI), and aramide (PPTA, poly-(paraphenylene terephthalamide)).

In the multi-functional vibration actuator of this invention, a lead wire for the coil fixedly attached to the vibrator member is laid on the surface of the vibrator member in a V shape, a U shape, a bellows-like shape, or a combination thereof and is attached to a desired point of the vibrator member by the use of an elastic member, such as an adhesive, applied in a spot-like fashion. Preferably, the lead wire is attached to a point on the outer periphery of the vibrator member. With this structure, an unstable operation of the vibrator member in a sound mode is suppressed to reduce distortion of a generated sound. In addition, it is possible to prevent a lead wire for the coil from being interrupted even if an input driving voltage of a high level is supplied and even if the actuator is driven for a long time.

DESCRIPTION OF THE PREFERRED EMBODIMENT

Figure 1:
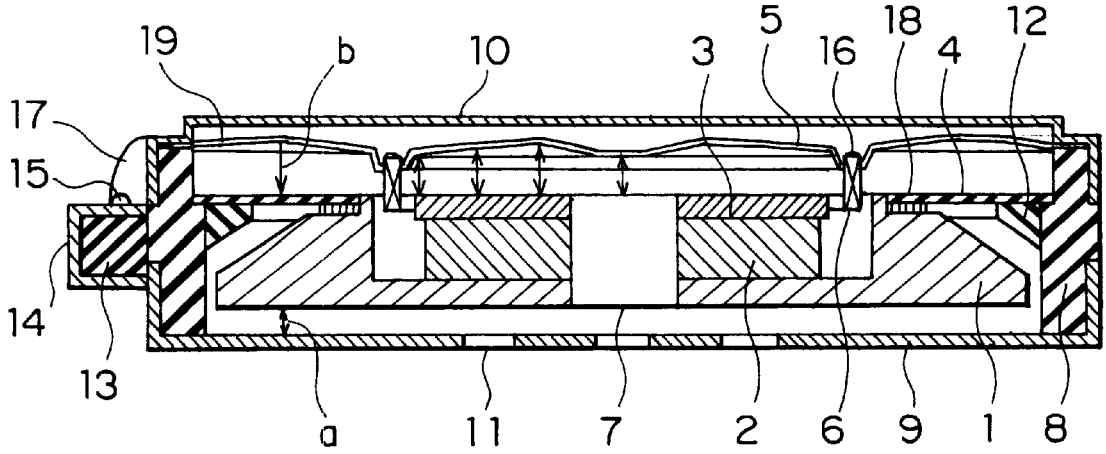
FIG. 1 is a sectional view of a multi-functional vibration actuator according to an embodiment of this invention.

Now, description will be made of a multi-functional vibration actuator according to an embodiment of this invention with reference to the drawing.

Referring to FIG. 1, the multi-functional vibration actuator is of an inner or center magnet type. The multi-functional vibration actuator has a magnetic circuit comprising a disk-shaped permanent magnet 2 interposed between a yoke 1 and a plate 3 arranged on lower and upper surfaces of the permanent magnet 2, respectively. The magnetic circuit (hereinafter depicted by 1-2-3) has a center hole with a center shaft 7 of a bolt-like or a pin-like shape inserted and fitted therein. The center shaft 7 serves to coaxially position the yoke 1, the permanent magnet 2, and the plate 3 as magnetic circuit components. These magnetic components are fixed to the center shaft 7 by staking or caulking. It is noted here that the center shaft 7 may be removed after the magnetic circuit components are coaxially positioned.

The magnetic circuit components are fixed by attraction force of the permanent magnet 2, a combination of the attraction force and an adhesive, or caulking to the center shaft 7. The vibration actuator further includes a suspension 4 comprising an arc-shaped helical leaf spring. The suspension 4 has inner and outer edges fixed to an outer periphery of the yoke 1 and a vibration transmitting portion 8, respectively.

As described above, the magnetic circuit 1-2-3 is of the inner magnet type. However, the magnetic circuit 1-2-3 may be of a different type, such as an outer or peripheral magnet type or a radial structure. In either of the inner magnet type and the outer magnet type, an end portion of the yoke 1 of the magnetic circuit 1-2-3 is formed into an uneven or non-flat shape having a protrusion or a recess in order to help the generation of a high magnetic flux density. A magnetic pole of the permanent magnet 2 may be oriented in any direction.

The suspension 4 is fixed to the outer periphery of the yoke 1 by the use of an elastic member 18 such as a tackiness agent, an adhesive, and a resin or by means of caulking or staking. The suspension 4 serves to flexibly support the magnetic circuit 1-2-3. In this embodiment, the suspension 4 is integrally coupled with the vibration transmitting portion 8 by insert molding, welding, adhesion, or the like.

The vibration actuator further comprises a vibrator member 5 arranged above the upper surface of the magnetic circuit 1-2-3 with a nonuniform distance (b) kept therefrom. The vibrator member 5 has a desired thickness and a desired shape selected from a flat shape, a saucer shape, a curved shape, a corrugated shape, and a combination thereof. In case of the curved shape, the vibrator member 5 may have a single radius of curvature or a combination of different radii of curvature. Furthermore, the vibrator member 5 may have a radius of curvature such that the rigidity of the vibrator member 5 is increased in a portion inside the coil 6 so as to minimize a harmonic distortion component. Thus, the contact between the vibrator member 5 and each of the magnetic circuit 1-2-3 and the suspension 4 is avoided in a vibration mode while a predetermined sound characteristic is obtained in a sound mode.

In this embodiment, the vibrator member 5 is made of polyether imide (PEI). Alternatively, the vibrator member 5 may be made of another plastic film material such as polyethylene terephthalate (PET), polycarbonate (PC), polyphenylenesulfide (PPS), polyarylate (PAR), polyimide (PI), and aramide (PPTA, poly-(paraphenylene terephthalamide)).

An outer periphery of the vibrator member 5 is coaxially attached to the vibration transmitting portion 8, if necessary, through an elastic member such as a tackiness agent, an adhesive, or a resin in order to obtain a greater amplitude of the vibrator member 5. The vibration transmitting portion 8 is made of a resin material exhibiting an elasticity.

On the other hand, the coil 6 is fixedly attached to a surface of an U-shaped portion 16 of the vibrator member 5 by the use of an adhesive or the like. The coil 6 is arranged in a gap within the magnetic circuit 1-2-3. The U-shaped portion 16 serves to prevent the coil 6 from being released from the vibrator member 5 with a high reliability.

The vibration transmitting portion 8 is provided with a bottom cover 9 and a top cover 10 for protection of a functional body exhibiting the vibration. The bottom cover 9 is formed on the side of the lower surface of the magnetic circuit 1-2-3 with a distance (a) kept therefrom while the top cover 10 is formed on the side of the upper surface of the magnetic circuit 1-2-3 to cover the vibrator member 5.

In order to reduce the harmonic distortion component around a resonance frequency by suppressing an unstable nonlinear operation of the vibrator member 5, the bottom cover 9 fixed to the vibration transmitting portion 8 is provided with at least one sound release hole 11 having a desired diameter for attenuating air viscosity. The sound release hole 11 may have a form of a circle, an ellipse, an elongated circle, a polygon, or a combination thereof. The bottom cover 9 must have a structure such that no air flows outward or inward except through the sound release hole 11 for attenuating air viscosity.

As described above, the suspension 4 is fixed to the outer periphery of the yoke 1 so as to suppress shaking of the magnetic circuit 1-2-3. In order to prevent the magnetic circuit 1-2-3 from being brought into contact with the vibrator member 5 due to an excessive amplitude upon occurrence of the shock of a fall, the vibration transmitting portion 8 is provided with at least one stopper 12 formed on an inner peripheral surface thereof. The stopper 12 may be formed throughout the inner peripheral surface.

In this state, a driving current is applied to the coil 6. Then, the vibrator member 5 fixed to the vibration transmitting portion 8 and the magnetic circuit 1-2-3 flexibly supported by the suspension 4 vibrate. The vibration transmitting portion 8 serves as a fixed portion at a low frequency but, at a high frequency, acts as an elastic member which vibrates as a part of the vibrator member 5. The magnetic circuit 1-2-3 and the coil 6 fixedly attached to the vibrator member 5 interact with each other to operate in reverse phases.

Figure 2:
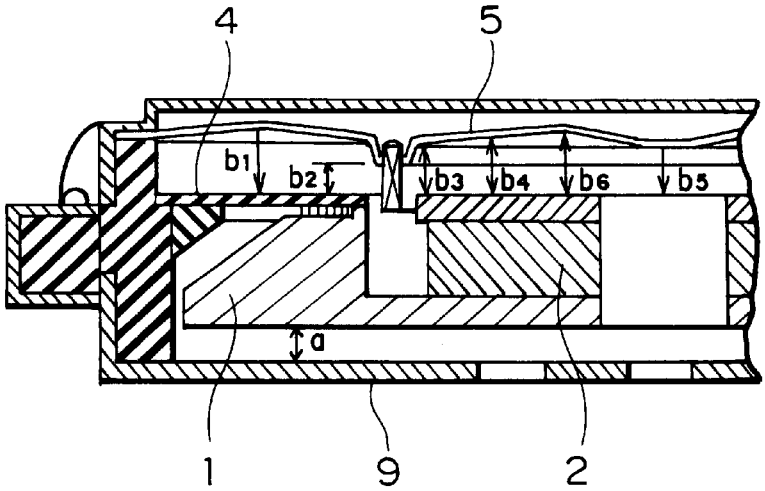
FIG. 2 is an enlarged view of a characteristic part in FIG. 1.

Next referring to FIG. 2 in addition to FIG. 1, an operation in the vibration mode will be described.

The magnetic circuit 1-2-3 and the coil 6 fixedly attached to the vibrator member 5 interact with each other and operate in reverse phases as mentioned above. Therefore, as illustrated in the figure, the distance (bi (i=1, 2, 3, . . . , n)) between the vibrator member 5 and each of the magnetic circuit 1-2-3 and the suspension 4 is selected taking into account the amplitude of each of the magnetic circuit 1-2-3 and the vibrator member 5. Specifically, a minimum distance ($b_{min}$) is greater than the distance (a) between the magnetic circuit 1-2-3 and the bottom cover 9 ($a<b_{min}$). With this structure, the vibrator member 5 is prevented from being brought into contact with the magnetic circuit 1-2-3 or the suspension 4.

As a specific example of this invention, a multi-functional vibration actuator having an outer diameter (ϕ) 17 mm and a height (t) 4.3 mm produces a predetermined vibration acceleration around the resonance frequency in the vibration mode. In this case, an abnormal sound is produced by an undesired contact when the amplitude of the vibrator member exceeds about 50 μm and the amplitude of the magnetic circuit exceeds about 600 μm. Therefore, the minimum distance between the vibrator member and each of the magnetic circuit and the suspension is selected to be "50+

600α" μm and the minimum distance between the magnetic circuit and the bottom cover is selected to be "600+α", where α is an allowance.

Figure 3:
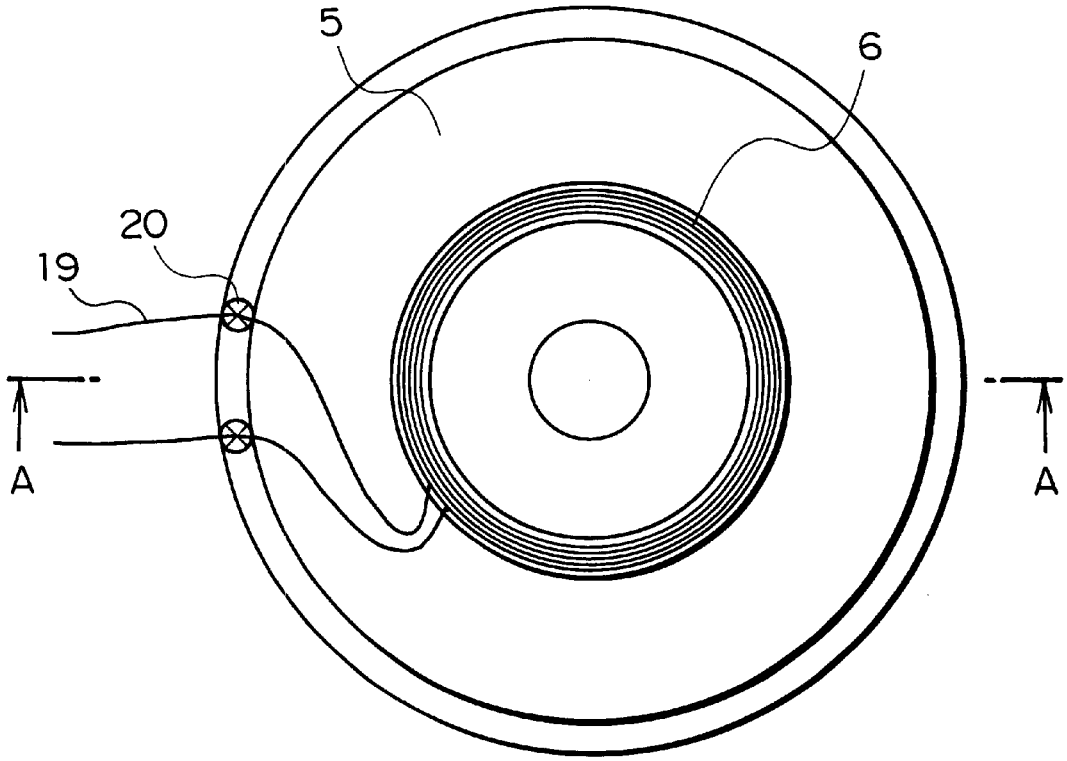
FIG. 3 is a plan view of the multi-functional vibration actuator in FIG. 1 with a coil wire fixedly attached to a vibrator member.

Next referring to FIG. 3 in addition to FIG. 1, description will be made of an arrangement of a pair of lead wires 19 for supplying the coil 6 with the driving current.

In order to extract the lead wires 19 to the outside, each of the lead wires 19 can be entirely adhered to the vibrator member 5 via the elastic member such as an adhesive to extend in a normal direction with respect to the vibrator member 5. This, however, will bring about an unstable operation of the vibrator member in the sound mode as described above. Furthermore, if the input driving voltage is increased or if the vibration actuator is driven for a long time, line interruption may be caused to occur so that the vibration actuator becomes inoperable.

Taking the above into consideration, the lead wires 19 are laid on the surface of the vibrator member 5 in a V shape, an U shape, a bellows-like shape, or a combination thereof so as to avoid adverse influence upon vibration of the vibrator member 5. Then, each of the lead wires 19 is adhered to one point on the outer periphery of the vibrator member 5, where the vibration is small, by the use of an elastic member 20, such as an adhesive, applied in a spot-like fashion, as illustrated in the figure. Each of the lead wires 19 may be adhered to any desired position of the vibrator member 5 as far as the following function is achieved. With this structure, the unstable operation in the sound mode is suppressed to reduce the distortion. In addition, line interruption due to the input driving voltage of a high level and the driving of the vibration actuator for a long time can be prevented.

Furthermore, as illustrated in FIG. 1, the vibration transmitting portion 8 is provided with a terminal support 13 formed on the outer periphery thereof. The lead wires 19 are connected to the terminal plate 14 on the terminal support 13 by the use of a solder 15. The lead wires 19 and the connecting portion thereof are covered with a protector 17.

As described above, according to this invention, the distance between the vibrator member and each of the magnetic circuit and the suspension is greater than the distance between the magnetic circuit and the bottom cover. Furthermore, the vibrator member is formed into a flat shape, a saucer shape, a curved shape, a corrugated shape, or a combination thereof and has a desired radius of curvature such that the harmonic distortion component is minimized. With this structure, it is possible to provide a multi-functional vibration actuator capable of avoiding the contact between the magnetic circuit and the vibrator member around the resonance frequency in the vibration mode.

According to this invention, each of the lead wires for the coil fixedly attached to the vibrator member is laid on the surface of the vibrator member in a V shape, an U shape, a bellows-like shape, or a combination thereof and is attached to a desired portion of the vibrator member by the use of an elastic member, such as an adhesive, applied in a spot-like fashion. With this structure, it is possible to provide a multi-functional vibration actuator capable of suppressing an unstable operation in the sound mode and avoiding line interruption due to an input driving voltage of a high level and the driving of the vibration actuator for a long time.

What is claimed is:

1. A multi-functional vibration actuator comprising:

a vibration transmitting portion forming a peripheral portion of said actuator, a magnetic circuit comprising a permanent magnet and a magnetic yoke, said magnetic circuit having a magnetic gap therein, and said magnetic curcuit having first and second surfaces opposite to each other, a vibrator member arranged at a distance from said first surface of said magnetic circuit and having an outer periphery fixed to said vibration transmitting portion, a coil arranged in said gap within said magnetic circuit at a distance from said magnetic circuit and fixedly attached to said vibrator member, and a suspension fixed to said vibration transmitting portion and flexibly supporting said magnetic circuit, wherein a cover is fixedly mounted to said vibration transmitting portion and covers said second surface of said magnetic circuit with a space left between said cover and said second surface of said magnetic circuit, wherein the distance between said vibrator member and said first surface of said magnetic circuit is greater than the space between the second surface of said magnetic circuit and said cover, and wherein said vibration transmitting portion is provided with at least one stopper for preventing said magnetic circuit from being brought into contact with said vibrator member due to an excessive amplitude.

2. A multi-functional vibration actuator as claimed in claim 1, wherein said vibrator member has a radius of curvature such that a harmonic distortion component is suppressed, and said vibrator member has a shape such that contact with said magnetic circuit is avoided.

3. A multi-functional vibration actuator as claimed in claim 1, wherein said vibrator member is made of at least one kind of plastic film material selected from polyether imide, polyethylene terephthalate, polycarbonate, polyphenylenesulfide, polyarylate, polyimide, and aramide.

4. A vibration actuator comprising:

a vibration transmitting portion forming a peripheral portion of said actuator, a magnetic circuit comprising a permanent magnet and a magnetic yoke, said magnetic circuit having a magnetic gap therein, and said magnetic circuit having first and second surfaces opposite to each other, a vibrator member arranged at a distance from said first surface of said magnetic circuit and having an outer periphery fixed to said vibration transmitting portion, a coil arranged in said gap within said magnetic circuit at a distance from said magnetic circuit and fixedly attached to said vibrator member, and a suspension fixed to said vibration transmitting portion and flexibly supporting said magnetic circuit, wherein a cover is fixedly mounted to said vibration transmitting portion and covers said second surface of said magnetic circuit with a space left between said cover and said second surface of said magnetic circuit, wherein the distance between said vibrator member and said first surface of said magnetic circuit is greater than the space between the second surface of said magnetic circuit and said cover, wherein said vibration transmitting portion is provided with at least one stopper for preventing said magnetic circuit from being brought into contact with said vibrator member due to an excessive amplitude, and wherein said vibrator member is formed in a shape including at least one of a flat shape, a saucer shape, a curved shape, and a corrugated shape.

5. A multi-functional vibration actuator as claimed in claim 4, wherein said vibrator member is made of at least one kind of plastic film material selected from polyether imide, polyethylene terephthalate, polycarbonate, polyphenylenesulfide, polyarylate, polyimide, and aramide.

6. A vibration actuator comprising:

a vibration transmitting portion forming a peripheral portion of said actuator, a magnetic circuit comprising a permanent magnet and a magnetic yoke, said magnetic circuit having a magnetic gap therein, and said magnetic circuit having first and second surfaces opposite to each other, a vibrator member arranged at a distance from the first surface of said magnetic circuit and having an outer periphery fixed to said vibration transmitting portion, a coil arranged in said gap within said magnetic circuit at a distance from said magnetic circuit and fixedly attached to said vibrator member, and a suspension fixed to said vibration transmitting portion and flexibly supporting said magnetic circuit, wherein a cover is fixedly mounted to said vibration transmitting portion and covers said second surface of said magnetic circuit with a space left between said cover and said second surface of said magnetic circuit, wherein the distance between said vibrator member and the first surface of said magnetic circuit is greater than the space between the second surface of said magnetic circuit and said cover, wherein said vibration transmitting portion is provided with at least one stopper for preventing said magnetic circuit from being brought into contact with said vibrator member due to an excessive amplitude, and wherein a lead wire for said coil is laid on a surface of said vibrator member in a shape including at least one of a V shape, a U shape, and a bellows-like shape, and said lead wire is attached to a desired position of said vibrator member by an elastic member.

7. A multi-functional vibration actuator as claimed in claim 6, wherein said desired position is a point on said outer periphery of said vibrator member.

8. A multi-functional vibration actuator as claimed in claim 6, wherein said vibrator member is made of at least one kind of plastic film material selected from polyether imide, polyethylene terephthalate, polycarbonate, polyphenylenesulfide, polyarylate, polyimide, and aramide.

9. A vibration actuator comprising:

a vibration transmitting portion forming a peripheral portion of said actuator, a magnetic circuit comprising a permanent magnet and a magnetic yoke, said magnetic circuit having a magnetic gap therein, and said magnetic circuit having first and second surfaces opposite to each other, a vibrator member arranged at a distance from the first surface of said magnetic circuit and having an outer periphery fixed to said vibration transmitting portion, a coil arranged in said gap within said magnetic circuit at a distance from said magnetic circuit and fixedly attached to said vibrator member, and a suspension fixed to said vibration transmitting portion and flexibly supporting said magnetic circuit, wherein a cover is fixedly mounted to said vibration transmitting portion and covers said second surface of said magnetic circuit with a space left between said cover and said second surface of said magnetic circuit, wherein the distance between said vibrator member and the first surface of said magnetic circuit is greater than the space between the second surface of said magnetic circuit and said cover, wherein said vibration transmitting portion is provided with at least one stopper for preventing said magnetic circuit from being brought into contact with said vibrator member due to an excessive amplitude, wherein said vibrator member is formed in a shape including at least one of a flat shape, a saucer shape, a curved shape, a corrugated shape, and wherein a lead wire for said coil is laid on a surface of said vibrator member in a shape including at least one of a V shape, a U shape, and a bellows-like shape, and said lead wire is attached to a desired position of said vibrator member by an elastic member.

10. A multi-functional vibration actuator as claimed in claim 9, wherein said desired position is a point on said outer periphery of said vibrator member.

11. A multi-functional vibration actuator as claimed in claim 9, wherein said vibrator member is made of at least one kind of plastic film material selected from polyether imide, polyethylene terephthalate, polycarbonate, polyphenylenesulfide, polyarylate, polyimide, and aramide.

* * * * *